United States Patent [19]

Payraudeau

[11] Patent Number: 4,589,538

[45] Date of Patent: May 20, 1986

[54] DEVICE FOR LOCKING AND RELEASING OBJECTS INTENDED FOR PUBLIC USE, SUCH AS LUGGAGE CARTS

[75] Inventor: Henri-André Payraudeau, Draguignan, France

[73] Assignee: MORS, France

[21] Appl. No.: 515,372

[22] Filed: Jul. 18, 1983

[30] Foreign Application Priority Data

Feb. 18, 1983 [FR] France ..... 83 02716
Apr. 26, 1983 [FR] France ..... 83 06857

[51] Int. Cl.[4] ..... G07F 17/10

[52] U.S. Cl. ..... 194/205; 194/253; 194/905

[58] Field of Search ..... 194/4 R, 4 B, 4 C, 4 D, 194/54, 55, 59, 1 E, 40

[56] References Cited

U.S. PATENT DOCUMENTS

| | | | |
|---|---|---|---|
| 441,536 | 11/1890 | Cornell | 194/102 X |
| 608,186 | 8/1898 | Doldt | 194/4 R |
| 608,769 | 8/1898 | Gilmer | 194/4 R |
| 2,753,970 | 7/1956 | Breeler | 194/40 |

FOREIGN PATENT DOCUMENTS

| | | | |
|---|---|---|---|
| 246487 | 6/1911 | Fed. Rep. of Germany . | |
| 400803 | 8/1924 | Fed. Rep. of Germany . | |
| 661352 | 6/1938 | Fed. Rep. of Germany | 194/55 |
| 718594 | 2/1942 | Fed. Rep. of Germany . | |
| 866471 | 2/1953 | Fed. Rep. of Germany . | |
| 1474887 | 7/1969 | Fed. Rep. of Germany | 194/55 |
| 2725530 | 12/1978 | Fed. Rep. of Germany . | |
| 2900367 | 7/1979 | Fed. Rep. of Germany | 194/4 R |
| 2058890 | 5/1971 | France . | |
| 2333687 | 1/1977 | France . | |
| 2425682 | 7/1979 | France . | |
| 8100107 | 6/1982 | PCT Int'l Appl. . | |

*Primary Examiner*—F. J. Bartuska
*Attorney, Agent, or Firm*—Steinberg & Raskin

[57] ABSTRACT

The present invention is directed to a device for locking and releasing objects intended for public use, such as luggage carts which can be taken from a common storage space and returned to the same. The device comprises a locking apparatus allowing each object to be automatically locked to an adjacent object or to a fixed point in compact storage position. A coin or the like is introduced into the locking apparatus to allow unlocking of the same and the concomitant release of the object by exerting a pull thereon. The locking apparatus returns the coin when the object is returned to the storage space and is locked to an adjacent object or to the fixed point. Unlocking of the object is accomplished by just exerting a pull thereon after the coin has been appropriately inserted into the locking apparatus.

9 Claims, 17 Drawing Figures

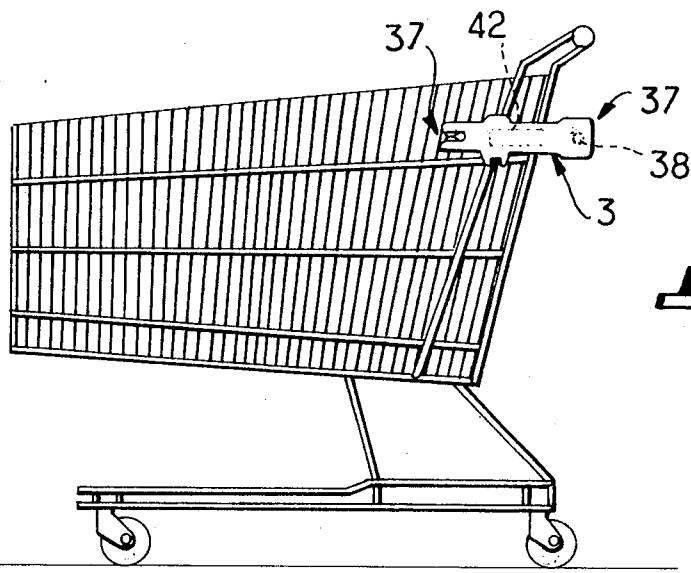
Fig. 4
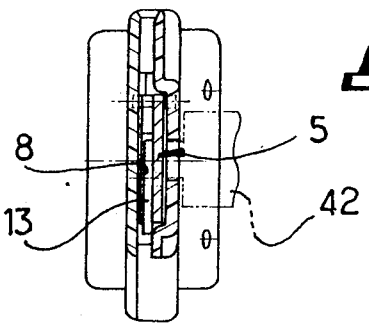
Fig. 12
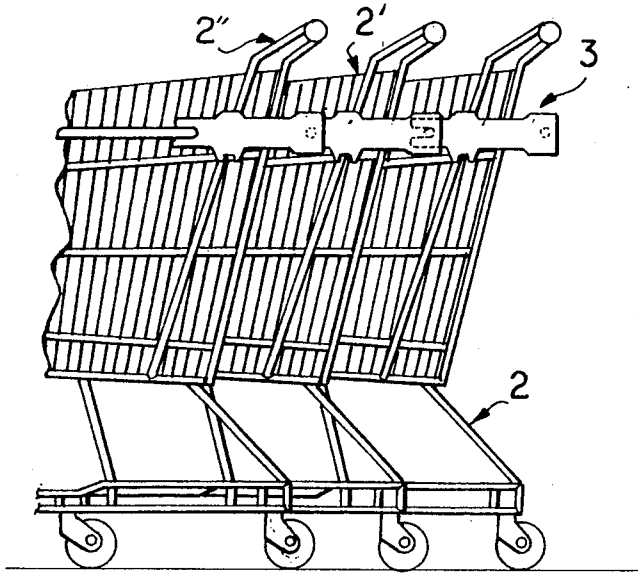
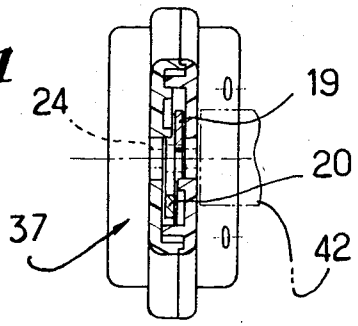
Fig. 11

DEVICE FOR LOCKING AND RELEASING OBJECTS INTENDED FOR PUBLIC USE, SUCH AS LUGGAGE CARTS

BACKGROUND OF THE INVENTION

The present invention has for a subject matter a device for locking and releasing objects intended for public use, particularly objects intended to be put at the public's disposal free of charge, such as luggage carts in a railway station or an airport, shopping trolleys in a self-service store, which objects the public can take directly from a common stowage space and must be taken back to the said space after being used.

It is known to provide such as object with a locking apparatus which allows locking it to an adjacent object or to a fixed point in a common stowage space. In the known systems, however, it is necessary, after introducing a coin or the like into the locking apparatus, to actuate a handle or press a button to unlock the object from an adjacent object or from a fixed point, the release of the object being thereafter obtained by exerting a pull thereon.

SUMMARY OF THE INVENTION

The purpose of the present invention is therefore to eliminate this additional, unlocking operation by providing a locking apparatus which is unlockable automatically by the introduction of a coin or the like, followed by a pull, and by preventing any fraud.

With this end in view, the present invention has for a subject manner a device for locking and releasing objects intended for public use, such as luggage carts, of the type comprising a locking apparatus allowing each object to be locked to the adjacent object or to a fixed point in stowed position, into which locking apparatus is introduced a coin or the like to allow unlocking the locking apparatus and the release of the object by exerting a pull thereon, the said locking apparatus being adapted to return the said coin or the like when the object is returned to the stowage space and is locked to an adjacent object or to a stationary point, characterized in that the said unlocking results from the said pull.

According to another feature of the invention, the said pull ensures successively the unblocking of the said locking apparatus and the release of the said object.

According to still another feature of the invention, the said locking apparatus comprises a slide movable under the action of the said pull and fixable by an internal blocking member which is moved to a non-blocking position by coming into contact with the edge of the said coin or the like, the said slide serving to lock or unlock the lock connecting the object to an adjacent object or to a fixed point.

According to another feature of the invention, the said locking apparatus comprises a movable means for retaining the said coin or the like in either of two positions in which the said coin is confined in the said locking apparatus, i.e., an active retained position ensuring the unlocking of the locking apparatus and an inactive retained position, respectively.

In order, in case a cart should be abandoned, to prevent the use of its locking bar to lock thereto one's cart, which would eventually result in an undesirable accumulation of carts at that location, the lock connecting the object to an adjacent object or to a fixed point is constituted, according to another feature of the invention, by a first or female and a second or male means secured to the end portion of the case of the locking apparatus.

BRIEF DESCRIPTION OF THE DRAWINGS

For a fuller understanding of the invention, reference is made to the following description taken in conjunction with the accompanying drawings, in which.

Figure 10:
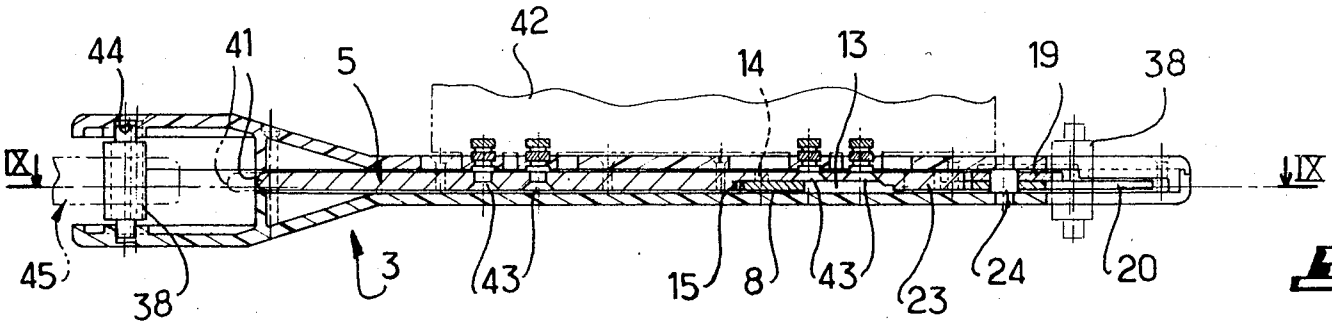

FIGS. *7a* to *7f* are diagrammatic sectional views illustrating the various stages of the operation of the device according to the invention;

FIG. 8 is a diagrammatic view of several carts locked together by a locking and releasing device according to another form of embodiment of the invention;

FIG. 9 is a view upon the line IX—IX of FIG. 10 illustrating one form of embodiment of a locking apparatus according to this second form of embodiment of the invention;

FIG. 10 is a view upon the line X—X of FIG. 9;

FIG. 11 is a view upon line XI—XI of FIG. 9; and

FIG. 12 is a view upon the line XII—XII of FIG. 9.

DETAILED DESCRIPTION OF THE PREFERRED EMBODIMENTS

Figure 1:
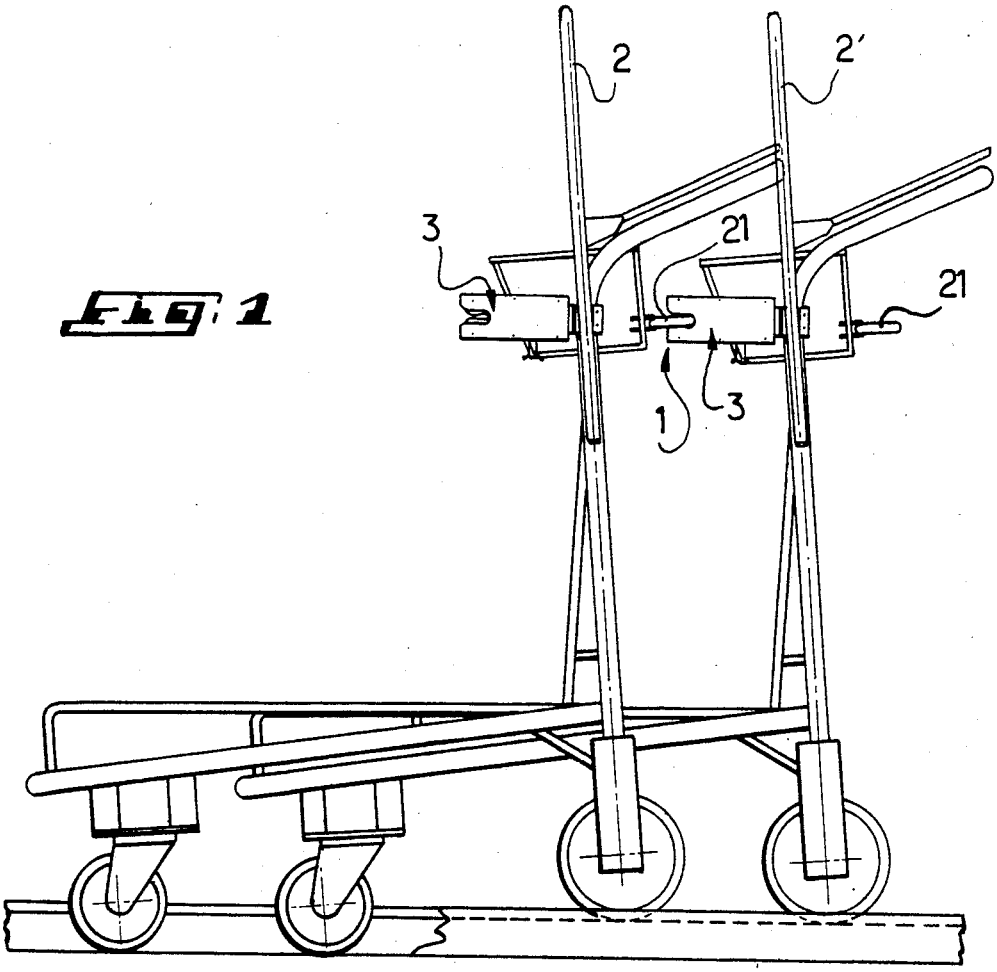
FIG. 1 is a diagrammatic view of two luggage carts locked together by a locking and releasing device according to the invention.
Figure 6:
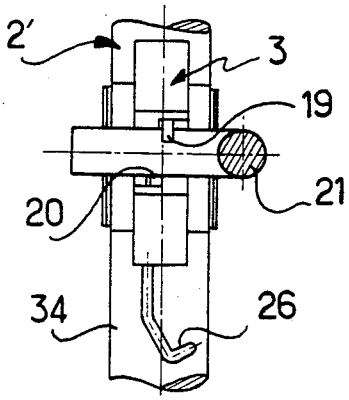
FIG. 6 is a view in the direction of arrow VI of FIG. 2.
Figure 2:
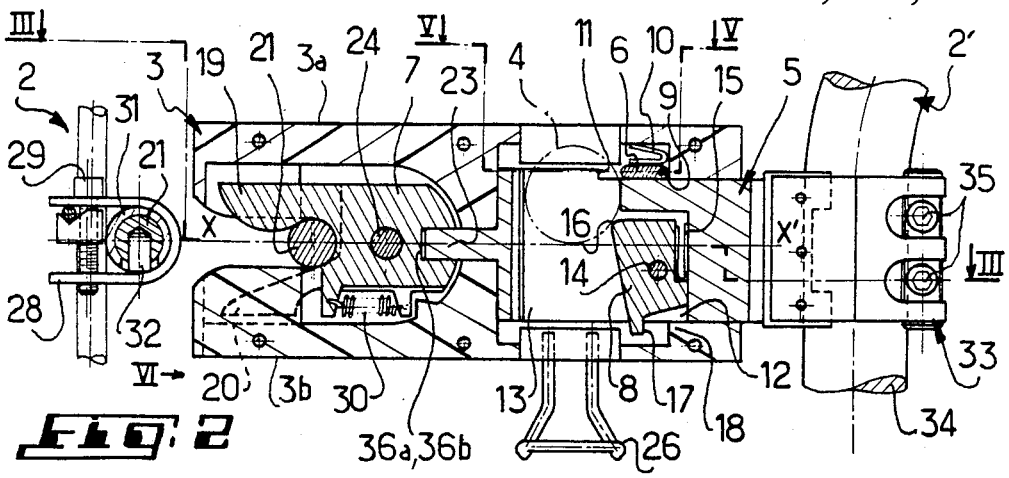
FIG. 2 is a view upon the line II—II of FIG. 3, illustrating one example of embodiment of a locking apparatus according to the invention.

Referring to FIG. 1, two luggage carts 2 are shown in stowed position, locking to one another by a device 1 according to the invention.

The locking and releasing device 1 may be used to lock together or to a fixed point different objects intended for public use, in particular objects put at the public's disposal free of charge, such as luggage carts 2, 2' as in the example illustrated, in a railway station or an airport, or shopping trolleys in a self-service store, which objects the public can take directly from a common stowage space and which must be returned to the said stowage space after use.

Referring now more particularly to FIGS. 2 to 6, the device 1 comprises a locking apparatus 3 allowing each object to be automatically locked to the adjacent object or to a fixed point in stowed position, into which locking apparatus is introduced a coin or the like 4 for unlocking the lock 3 and releasing the object by exerting a pull thereon, the locking apparatus 3 being designed to return the coin or the like 4 when the object is taken back to the stowage space and is locked to an adjacent object or to a fixed point. According to the invention, the unlocking is obtained by exerting a pull on the object.

In particular, the said pulling action ensures successively the unblocking of the locking apparatus 3 and the release of the object 2'.

The locking apparatus 3 comprises a slide 5 movable under the action of the said pull and fixable by an internal blocking member 6 which is movable to a non-blocking position, when a sufficient pull is exerted, by coming into contact with the edge of the coin 4, the slide 5 serving to lock or unlock the lock 7 connecting the object to an adjacent object or to a fixed point.

The locking apparatus 3 also comprises a movable means 8 for retaining the coin or the like 4 in either of two positions in which the coin is confined in the locking apparatus 3, i.e., an active retained position ensuring the unblocking of the locking apparatus 3 and an inactive retained position, respectively.

In the example illustrated, the said blocking member is constituted by a stop or abutment 6 pivotally mounted on a pivot pin 9 which is substantially horizontal and perpendicular to the longitudinal axis X—X' of the locking apparatus 3, the case of which is constituted particularly by an upper frame 3*a* and a lower frame 3*b*. The stop 6 may be acted upon by a U-shaped-strip return-spring 10.

The movable slide 5 has a shoulder 11 at its upper surface, opposite the free end of the stop 6. When no coin is introduced into the locking apparatus and when a pull is exerted on the object, the free end of the stop 6 moves into abutment against the shoulder 11, thus preventing the unlocking of the locking apparatus.

The aforesaid retaining means is particularly constituted by a rocker 8 provided in the recess 12 adjacent to the slit 13 extending throughout the locking apparatus 3 and pivotally mounted on a pivot pin 14 which is substantially horizontal and perpendicular to the longitudinal axis X—X'of the locking apparatus, the rocker 8 being acted upon by a spring 15. The rocker 8 may assume either of two positions according to whether a sufficient pull is or is not exerted on the object. Indeed, up to a predetermined value of the pulling action, the upper edge 16 of the rocker 8 retains the coin 4 in the slit 13 in its active position ensuring the unblocking of the locking apparatus 3. When this predetermined value is exceeded, the rocker 8 pivots by bearing with its lower edge 17 upon a shoulder 18 of the lower frame 3*b* of the locking apparatus 3, and the coin 4 moves down in the slit 13 by gravity and assumes an inactive retained position. When the object 2' is returned to the stowage space and is locked to an adjacent object or to a fixed point, the rocker 8 pivots in the opposite direction and releases the coin 4 from the slit 13. The coin can thus be recovered.

The connecting lock 7 is advantageously constituted by a clamp constituted by two unsymmetrical jaws 19, 20 pivotally mounted about a pin 24 which is substantially horizontal and perpendicular to the longitudinal axis X—X'of the locking apparatus 3. The jaws 19, 20 are acted upon by a spring 30 and so designed that only a connecting bar 21 secured to the adjacent object or to a fixed point and whose diameter is perfectly calibrated can fit in therebetween and lock the object. The connecting bar 21 may be provided with a torsion spring 22 so as to be resiliently rotatable through a certain angle to compensate for the difference in height between two adjacent carts, due for example to the mounting tolerances or the unevenness of the ground or to tire wear.

Figure 3:
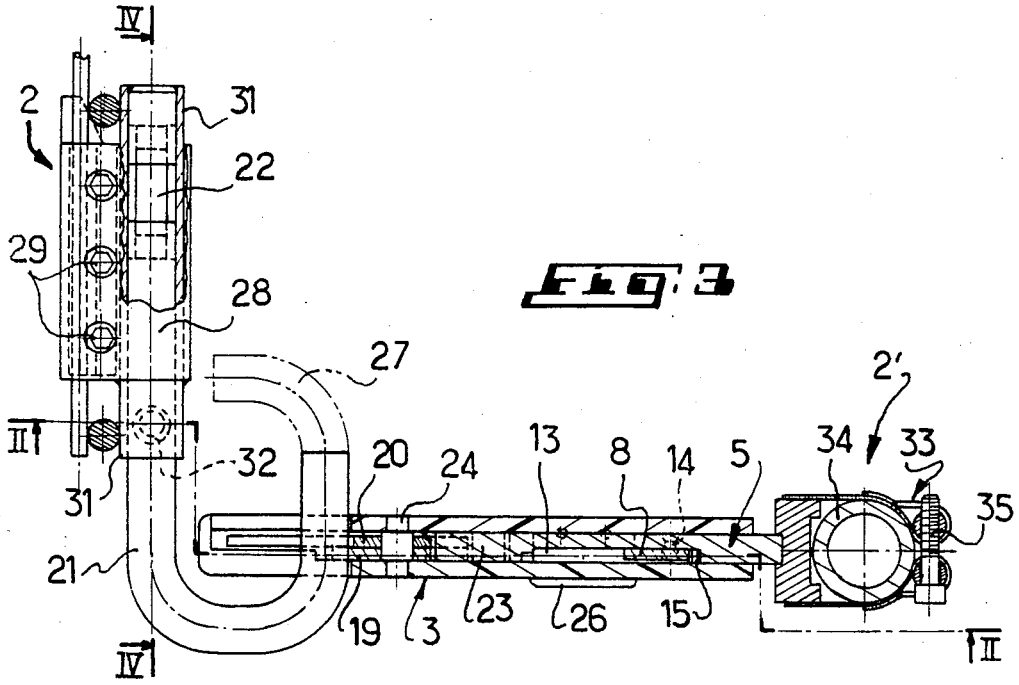
FIG. 3 is a view upon the line III—III of FIG. 2.
Figure 4:
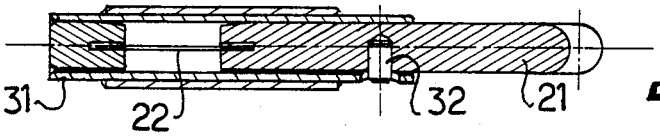
FIG. 4 is a view upon the line IV—IV of FIG. 3.
Figure 5:
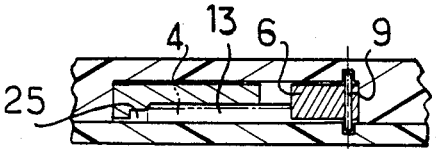
FIG. 5 is an enlarged view upon the line V—V of FIG. 2.

In case there is a possibility of lateral movement of the object, the bar 21 may be prolonged by a bend 27 shown in dash-dotted lines in FIG. 3, which bend may, if appropriate, be prolonged to form a closed loop.

The connecting bar 21 may be secured to the adjacent object by means of, for example, a U-shaped plate 28 by means of safety screws 29. A sleeve 31 may be arranged between the bar 21 and the plate 28 and secured for example by means of a screw 32.

Furthermore, the movable slide is provided with a tongue 23 holding the jaws 19, 20 of the clamp 7 in closed position. To this end, the jaws 19, 20 are provided, on their innermost portion in the locking apparatus, with mutually opposite recesses 36*a*, 36*b* which, in the locked position of the locking apparatus, define a space in which the free end of the tongue 23 is located so as to block the locking apparatus in that position.

The slit 13 extending throughout the locking apparatus includes an anti-fraud extension 25 the width of which is smaller than the thickness of the required coin, so that a coin of the same diameter but of smaller thickness than the required coin traverses the locking apparatus without being retained therein.

Also provided is a coin recovery means 26 secured to the lower surface of the lower frame 3*b* of the locking apparatus in prolongation of the slit 13.

The locking apparatus 3 is secured to the handlebar 34 of the cart 2' by fastening means 33 including particularly safety crews 35.

Referring more particularly to FIGS. 7*a* to 7*f*, there will now be described the various phases of operation of the locking and releasing device according to the invention.

Figure 7A:
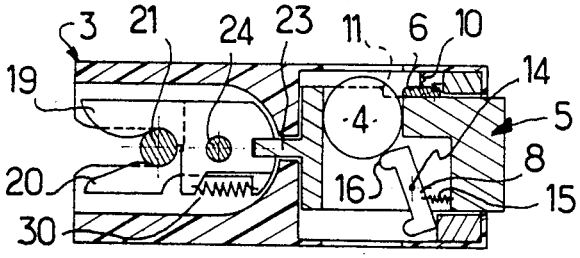

FIG. 7*a* illustrates the phase of introduction of the coin of the like 4 into the locking apparatus 3. Once in the slit 13, the coin 4 is retained therein by the upper end 16 of the rocker 8 in an active position ensuring the unblocking of the locking apparatus. In this position of the coin 4, when a pull is exerted on the object, the free end of the stop 6 slips on the edge of the coin 4, thus preventing it from abutting against the shoulder 11 of the slide 5. This position corresponds to the unblocking of the locking apparatus.

Figure 7B:
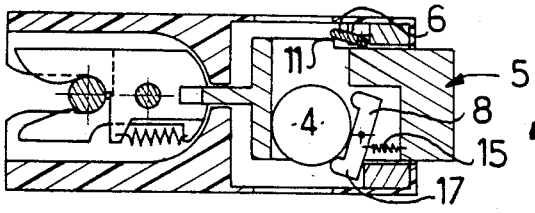
Figure 7C:
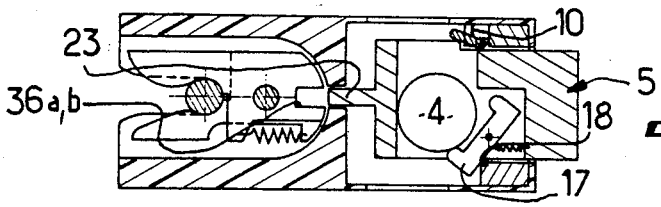

As the pull is continued, the lower end 17 of the rocker 8 abuts against the shoulder 18 of the lower frame 3*b* of the locking apparatus 3, so that the rocker 8 pivots and frees the coin 4 from its preceding position. The coin then falls by gravity in the slit 13 where it assumes an inactive retaining position (FIG. 7*b*). The stop 6 then rests on the edge of the shoulder 11.

Figure 7D:
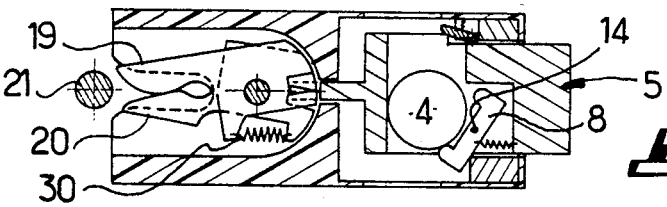
Figure 7E:
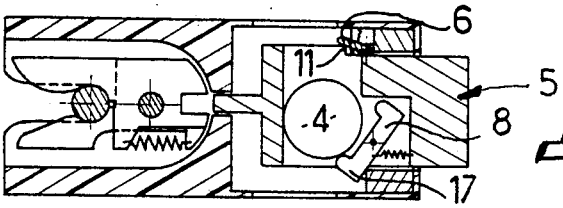

As the pull is continued, the tongue 23 of the slide 5 leaves the space defined by the mutually opposite recesses 36*a*, 36*b* of the jaws 19, 20 of the clamp 7 (FIG. 7*c*), thus causing the jaws 19, 20 to pivot about their pivot pin 24 under the action of the return spring 30 and thus free the calibrated bar 21 (FIG. 7*d*). This corresponds to the unlocking of the locking apparatus. In this position of the jaws 19, 20, the recesses 36*a*, 36*b* are no longer opposite one another, so that, so long as a calibrated bar 21 is not inserted between the jaws 19, 20, the slide 5 is blocked in the unlocked position.

Figure 7F:
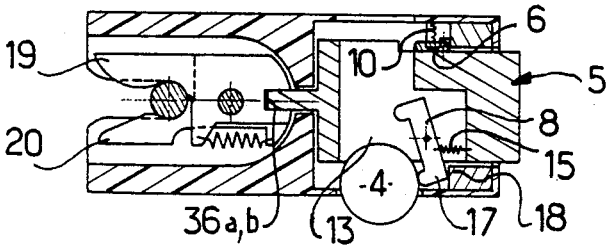
Figure 5:
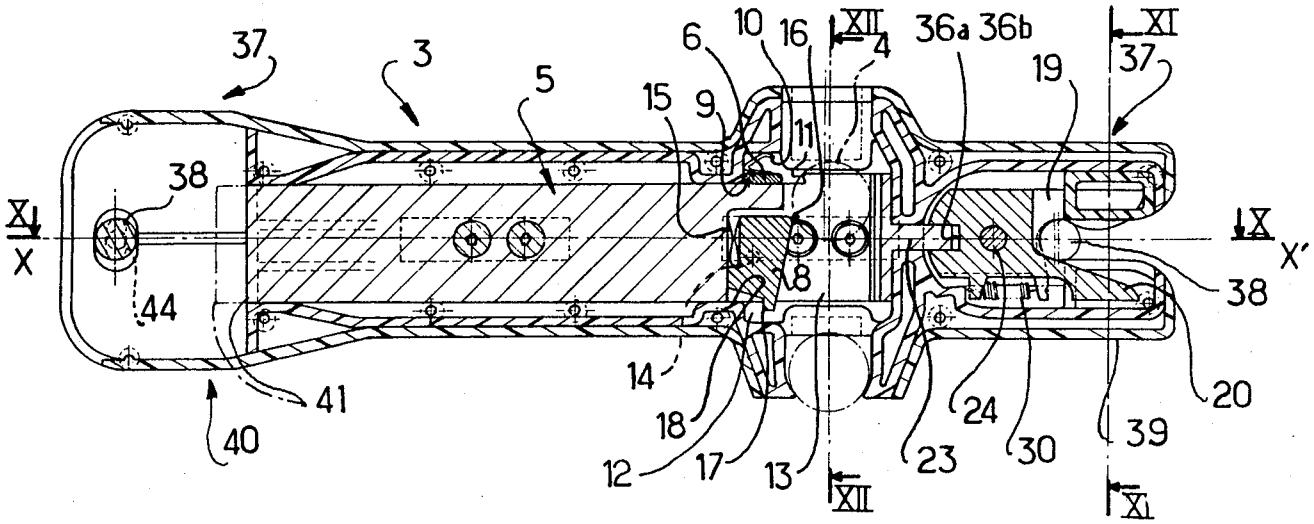

When the object, for example a luggage cart, is returned to the stowage space, a push exerted on the latter allows inserting the calibrated bar 21 between the jaws 19, 20 of the clamp 7 (FIG. 7*e*), so that the recesses 36*a*, 36*b* are again opposite one another. As the push is continued, the tongue 23 of the slide 5 moves into the space defined by the recesses 36*a*, 36*b*, whereas the rocker 8 pivots and the coin 4 is freed (FIG. 7*f*). At the same time, the stop 6 reassumes its initial horizontal position and the locking apparatus 3 is then again locked. As appears from FIG. 7*f*, of no coin or the like is introduced into the locking apparatus and in case a pull is exerted on the object, the stop 6 will abut against shoulder 11 and prevent the unlocking of the lock.

Referring to FIG. 8, several luggage carts 2, 2', 2'' are shown in stowed position and locked to one another by a device according to a second form of embodiment of the invention.

Referring now to FIGS. 9 to 10, the device comprises a locking apparatus 3 allowing each object to be automatically locked to the adjacent object or to a fixed point in stowed position, in which locking apparatus is introduced a coin or the like 4 to authorize the unlocking of the locking apparatus 3 and the release of the object by a pull exerted thereon, the locking apparatus 3 being designed to return the coin 4 when the object is returned to the stowage space and is locked to an adjacent object or to a fixed point, the locking being performed by exerting a pull on the object. In particular, the said pull results successively in the unblocking of the locking apparatus 3 and the unlocking of the object.

It is recalled that the locking apparatus 3 comprises a slide 5 which is movable by the said pull and fixable by an internal blocking member 6 which is moved to a non-blocking position, when a sufficient pull is exerted, by coming into contact with the edge of the coin 4, the slide 5 serving to lock or unlock the lock 37 connecting the object to an adjacent object or to a fixed point.

The locking apparatus 3 also comprises a movable means 8 for retaining the coin 4 in either of two positions in which the coin is confined in the locking apparatus 3, i.e., an active retained position ensuring the unblocking of the locking apparatus 3 and an inactive retained position, respectively.

In the example illustrated, the blocking member is constituted by a stop or abutment 6 mounted pivotally about a substantially horizontal pivot pin 9 perpendicular to the longitudinal axis X—X′ of the locking apparatus 3. The stop 6 is acted upon by a U-shaped-strip return-spring 10.

The movable slide 5 is provided with a shoulder 11 at its upper face, opposite the free end of the stop 6. When no coin is introduced into the locking apparatus and when a pull is exerted on the object, the free end of the stop 6 abuts against the shoulder 11, thus preventing the unlocking of the locking apparatus.

The said retaining means is particularly constituted by a rocker 8 provided in the recess 12 adjacent to the slit 13 traversing the locking apparatus 3 and pivotally mounted about a substantially horizontal pivot pin 14 perpendicular to the longitudinal axis X—X′ of the locking apparatus, the rocker 8 being acted upon by a spring 15. The rocker 8 can assume two positions according to whether a sufficient pull is exerted on the object or not. Indeed, up to a predetermined value of the pull, the upper edge 16 of the rocker 8 retains the coin 4 in the slit 13 in an active position in which the locking apparatus 3 cannot be locked. When this predetermined value is exceeded, the rocker 8 pivots by bearing its lower edge 17 on the shoulder 18 of the frame of the locking apparatus 3, and the coin 4 moves downward in the slit 13 by gravity and assumes an inactive retained position. When the object is returned to the stowage space and is locked to an adjacent object or to a fixed point, the rocker 8 pivots in the opposite direction, thus feeding the coin in the slit 13. The coin can thus be recovered.

According to this second form of embodiment of the invention, the lock 37 for connecting the object to an adjacent object or to a fixed point is constituted by a first or female and a second or male means secured to the longitudinal endmost portion 39, 40, respectively, of the case of the locking apparatus 3. The said first means secured to the longitudinal end 39 of the locking apparatus 3, i.e., as in the example illustrated, the right-hand end in FIG. 9, is constituted particularly by a clamp consisting of two unsymmetrical jaws 19, 20 acted upon by a spring 30 and so designed that only the connecting or locking bar 38, constituting the said second means, for an adjacent object, and whose diameter is perfectly calibrated, can fit in therebetween. In the example illustrated, the connecting bar 38 is secured to the endmost portion 40 of the case of the locking apparatus 3 (at the left in FIG. 9) adjacent to the free end 41 of the slide 5, and is spaced from the latter, in locked position, by a sufficient space to introduce the said bar between the jaws of the locking apparatus of an adjacent object.

Thus, in the unlocked position, the free end 41 of the slide 5, shown in FIG. 10 in dash-dotted lines, prevents the locking of the cart to another cart. Indeed, the space then existing between the connecting bar 38 and the free end 41 of the slide 5 is insufficient to allow the introduction of the bar 38 between the jaws 19, 20 of another cart. Thus, in case a cart is abandoned, it is not possible, owing to this design of the locking apparatus, to use its locking bar in order to lock one's cart. In other words, the locking of a cart must compulsorily be effected to an already locked cart.

The movable slide 5 also comprises a tongue 23 locking the jaws 19, 20 of the clamp in locked position. Indeed, the jaws 19, 20 are provided, in their innermost portion in the locking apparatus, with recesses **36*a*, 36*b* arranged so as to be located opposite one another, in the locked position of the locking apparatus, to thus define a space in which the end of the tongue 23** is accommodated, in the locked position, so as to block the locking apparatus in this position.

The locking apparatus 3 may be secured to a cart by any appropriate fixing members 42 through the medium of appropriate fastening means 43 such as screws, bolts or the like.

Furthermore, there may be provided an oblong recess 44 for the calibrated bar 38 so as to compensate for the differences in height between the carts, and an opening 45 in the endmost portion 40 of the locking apparatus 3 so dimensioned as to provide a lateral clearance between the carts.

The operation of the locking apparatus has been described in detail with reference to the first form of embodiment.

The locking and releasing device according to the invention may also be used for storing collective tools in workshops. In this case, the locking apparatus is intended to lock or unlock a case in which the tool is contained. Every worker has a personal coin or the like marked for example with a number. When the worker wishes to use the tool, he introduces the coin into the locking apparatus, thus allowing the case containing the tool to be unlocked. The locking apparatus being provided with a transparent apeture, it can be seen, on the one hand, in case there is no coin in the locking apparatus, whether the object is available, or, on the other hand, in case a coin is seen in the locking apparatus, in the hands of what worker the tool is.

What is claimed is:

1. A device for locking and releasing objects intended for public use, especially objects intended to be put at public disposal free of charge such as luggage carts in a railway station or an airport or shopping carts in self-service stores, such objects capable of being taken directly from a common storage station and returned to the storage station, said device including a locking apparatus in the form of a casing and adapted to be affixed to a part of each object, attaching means for affixing said locking apparatus to a part of each object, a connecting lock having male and female means secured to respective longitudinal endmost portions of said casing forming said locking apparatus, for locking each object to an adjacent object or to a fixed point in compact storage position, and a slit provided in said casing through which a coin or the like is introduced to allow unlocking of said locking apparatus and release of the object by exerting a pull thereon, said locking apparatus being arranged to return the coin or the like when the object is returned to the storage station and is locked by said connecting lock to the adjacent object or to the fixed point, wherein said female means is constituted by a clamp comprising two unsymmetrical jaws, and said male means is constituted by a connecting bar secured to the object or to the fixed point, and having a diameter perfectly calibrated so that said male means can fit in between said jaws, and wherein said locking apparatus comprises a slide provided with a tongue blocking said clamp in locked position so as to lock said connecting lock connecting the object to the adjacent object or to the fixed point, an internal blocking member for fixing said slide and being movable to a non-blocking position by coming into contact with an edge of the coin introduced within said slit, said slide being movable within said casing, after introducing the coin within the slit, under the single action of the pull on the object which is directly applied to the slide so as to successively move the blocking member to the non-blocking position by coming into contact with the edge of the inserted coin, unlock the clamp of the connecting lock connecting the object to the adjacent object or to the fixed point and release the object.

2. A device according to claim 1, wherein said connecting bar is secured to the endmost portion of said casing of said locking apparatus adjacent to a free end of said slide and spaced from the latter, in the locked position, by a sufficient space to allow said bar to be inserted between said jaws of said locking apparatus of an adjacent object.

3. A device according to claim 1, wherein said locking apparatus comprises movable means for retaining the coin in either of two positions in which the coin is confined within said locking apparatus, said two positions being an active retained position ensuring unlocking of the locking apparatus and an inactive retained position respectively.

4. A device according to claim 2, wherein said blocking member comprises a pivotally mounted stop or abutment, and a substantially horizontal pivot pin about which said stop or abutment is pivotally mounted, said pivot pin being disposed perpendicular to a longitudinal axis of said locking apparatus.

5. A device according to claim 4, wherein said slide is provided with a shoulder at an upper face thereof opposite a free end of said stop or abutment.

6. A device according to claim 3, wherein said retaining means comprises a rocker provided in a recess adjacent to said slit extending throughout said locking apparatus, and a substantially horizontal pivot pin perpendicular to a longitudinal axis of said locking apparatus, and about which said rocker is pivotally mounted.

7. A device according to claim 1, wherein said connecting bar is provided with a torsion spring.

8. A device according to claim 1, wherein said slit extending throughout said locking apparatus comprises an extension having a width smaller than a thickness of the required coin, so that a coin of the same diameter but of a smaller thickness than the required coin traverses said locking apparatus without being retained therewithin.

9. A device for locking and releasing objects intended for public use, especially objects intended to be put at public disposal free of charge such as luggage carts in a railway station or an airport or shopping carts in self-service stores, such objects capable of being taken directly from a common storage station and returned to the storage station, said device including a locking apparatus in the form of a casing and adapted to be affixed to a part of each object, attaching means for affixing said locking apparatus to a part of each object, a connecting lock having male and female means secured to respective longitudinal endmost portions of said casing forming said locking apparatus, for locking each object to an adjacent object or to a fixed point in compact storage position, and a slit provided in said casing through which a coin or the like is introduced to allow unlocking of said locking apparatus and release of the object by exerting a pull thereon, said locking apparatus being arranged to return the coin or the like when the object is returned to the storage station and is locked by said connecting lock to the adjacent object or to the fixed point, wherein said female means is constituted by a clamp comprising two unsymmetrical jaws, and said male means is constituted by a connecting bar secured to the object or to the fixed point, and having a diameter perfectly calibrated so that said male means can fit in between said jaws, wherein said locking apparatus comprises a slide provided with a tongue blocking said clamp in locked position so as to lock said connection lock connecting the object to the adjacent object or to the fixed point, an internal blocking member for fixing said slide and being movable to a non-blocking position by coming into contact with an edge of the coin introduced within said slit, and wherein said connecting bar is secured to the endmost portion of said casing of said locking apparatus adjacent to a free end of said slide and spaced from the latter, in the locked position, by a sufficient space to allow said bar to be inserted between said jaws of said locking apparatus of an adjacent object, said slide being movable within said casing, after introducing the coin within the slit, under the single action of the pull on the object which is directly applied to the slide so as to successively move the blocking member to the non-blocking position by coming into contact with the edge of the inserted coin, unlock the clamp of the connecting lock connecting the object to the adjacent object or to the fixed point and release the object.

* * * * *